US009186036B2

(12) United States Patent
Wipperfurth et al.

(10) Patent No.: US 9,186,036 B2
(45) Date of Patent: Nov. 17, 2015

(54) DISHWASHER WITH DETERGENT DISPENSER

(75) Inventors: Franz-Josef Wipperfurth, Cadolzburg (DE); Knut Schneider, Nuremberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 530 days.

(21) Appl. No.: 13/697,095

(22) PCT Filed: May 9, 2011

(86) PCT No.: PCT/EP2011/002289

§ 371 (c)(1),
(2), (4) Date: Nov. 9, 2012

(87) PCT Pub. No.: WO2011/141145

PCT Pub. Date: Nov. 17, 2011

(65) Prior Publication Data

US 2013/0056042 A1 Mar. 7, 2013

(30) Foreign Application Priority Data

May 12, 2010 (EP) ..... 10005020

(51) Int. Cl.
*A47L 15/44* (2006.01)
*A47L 15/50* (2006.01)

(52) U.S. Cl.
CPC ..... *A47L 15/4409* (2013.01); *A47L 15/507* (2013.01)

(58) Field of Classification Search
CPC ..... A47L 15/4409; A47L 15/507
USPC ..... 134/56 D, 57 D, 58 D, 184
See application file for complete search history.

(56) References Cited

U.S. PATENT DOCUMENTS 5,787,911 A * 8/1998 Jacobus et al. ..... 134/201
2007/0006901 A1* 1/2007 Cho et al. ..... 134/25.2

(Continued)

FOREIGN PATENT DOCUMENTS

DE 89 16 289 4/1997
DE 102 48 512 4/2004
DE 10 2006 043976 3/2008

(Continued)

OTHER PUBLICATIONS

International Search Report for Application No. PCT/EP2011/002289, dated Aug. 9, 2011.

*Primary Examiner* — Michael Barr
*Assistant Examiner* — Levon J Shahinian
(74) *Attorney, Agent, or Firm* — Alston & Bird LLP

(57) ABSTRACT

The application relates to a dishwasher (10) which comprises: a washing chamber (12) with a top wall (18), a vertical back wall (14), two opposing vertical side walls (16), a water-collecting bottom (20) at its lower end, a frontal access opening (22) for loading articles to be cleaned, and a door (23) for closing said access opening, at least one basket (24) for accommodating the articles to be cleaned, wherein the basket is laterally supported for sliding movement out of and into the washing chamber on a pair of guide rails (30) which are opposingly arranged inside the washing chamber, and a dispenser (38, 40; 48) for providing an additive to cleaning water to be circulated within the washing chamber. In accordance with the invention the dispenser (38, 40; 48) is provided within one of the guide rails (30).

17 Claims, 2 Drawing Sheets

(56) References Cited

U.S. PATENT DOCUMENTS

Figure 1:
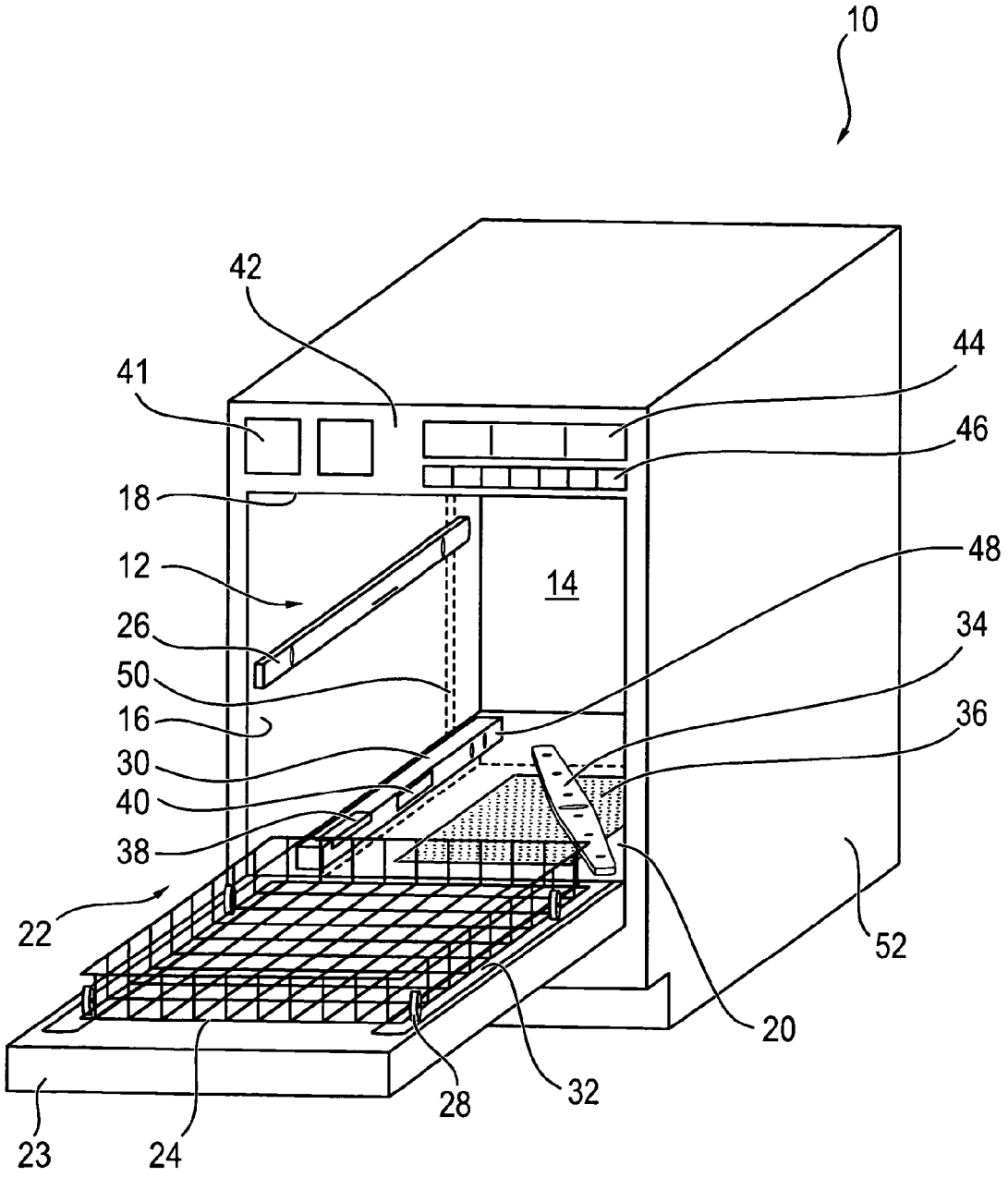

| | | | | |
|---|---|---|---|---|
| 2009/0102336 | A1* | 4/2009 | Buehlmeyer et al. | 312/228 |
| 2010/0012161 | A1 | 1/2010 | Classen et al. | |

FOREIGN PATENT DOCUMENTS

| | | |
|---|---|---|
| EP | 1 882 439 | 1/2008 |
| EP | 1 929 920 | 6/2008 |

* cited by examiner

DISHWASHER WITH DETERGENT DISPENSER

CROSS REFERENCE TO RELATED APPLICATIONS

This application is a national stage application filed under 35 U.S.C. 371 of International Application No. PCT/EP2011/002289, filed May 9, 2011, which claims priority from European Patent Application No. 10005020.2, filed May 12, 2010, each of which is incorporated by reference herein in its entirety.

The present invention relates to dishwasher comprising a washing chamber with a top wall, a vertical back wall, two opposing vertical side walls, a water-collecting bottom at its lower end, a frontal access opening for loading articles to be cleaned, and a door for closing said access opening; at least one basket for accommodating the articles to be cleaned, wherein the basket is laterally supported for sliding movement out of and into the washing chamber on a pair of guide rails which are opposingly arranged inside the washing chamber; and a dispenser for providing an additive to cleaning water to be circulated within the washing chamber.

In conventional dishwashers and in particular in dishwashers which are designed for domestic use, the dishwasher usually comprises a door which is hinged about a horizontal axis and which in the opened state forms a tray onto which the basket can be pulled out so as to facilitate the loading and unloading of dishes or other articles to be cleaned into and out of the basket.

In order to provide detergent to the washing liquid which is circulated within the washing chamber of the dishwasher, commonly a dispenser is provided at the interior side of the dishwasher door, which dispenser comprises a detergent compartment which at -the beginning of the washing cycle is closed by a lid, but which lid, upon completing a pre-wash step with clear tub water, is opened so that the detergent is transferred from the dispenser into the washing liquid. Such a dispenser is shown for example in DE-89 16 289 U1.

Since activating the dispenser is done electrically, such as by unlocking a spring biased lid, by the central control unit of the dishwasher, the dispenser has to be connected by means of electric wiring to the control unit and/or to a power supply.

Considering that in such conventional dishwashers, the electric wiring for connection of the dispenser has to be routed through the region of the door hinge, i.e. through a region which is repeatedly subject to rotational movements, specific efforts have to be taken to provide for the required product safety, all the more as the electric wiring extends in a critical region because the inner side of the door, during operation of the dishwasher, is wetted by washing liquid.

In view of the above problems, it is an object of the present invention to provide for a dishwasher which overcomes the wiring problem of conventional dishwashers.

In a dishwasher comprising a washing chamber with a top wall, a vertical back wall, two opposing vertical side walls, a water-collecting bottom at its lower end, a frontal access opening for loading articles to be cleaned, and a door for closing said access opening; at least one basket for accommodating the articles to be cleaned, wherein the basket is laterally supported for sliding movement out of and into the washing chamber on a pair of guide rails which are opposingly arranged inside the washing chamber; and a dispenser for providing an additive to cleaning water to be circulated within the washing chamber, in accordance with the present invention, this object is solved in that the dispenser is provided within one of the guide rails.

By providing the guide rail with a double function, i.e. providing support for the dishwasher basket and at the same time accommodating the dispenser, it is possible to relocate dispensers, such as detergent dispensers or rinse aid dispensers, from the dishwasher door into the interior of the washing chamber, so that it no longer is necessary to provide for electric wiring which extends into the hinged dishwasher door. Rather, the wiring thus can be routed into the guide rail accommodating the dispenser which, with the guide rail being a stationary member which is fixed within the dishwasher, can be implemented in a much easier and safer manner. By integrating the dispenser function into the guide rail, also savings in manufacturing costs can be achieved. Furthermore, locating the dispensers within the guide rails has the advantage that in contrast to prior art dispensers which are located in the dishwasher door and which comprise a lid that is opened during the washing cycle, a potential blocking of the dispenser by articles arranged within the dishwasher baskets and can be effectively avoided. Preferred embodiments of the present invention are defined in the dependent claims.

In particular, the dispenser can comprise an integral part of one of the guide rails. For example, if the guide rail is designed as an at least partially hollow member, such as a molded plastic component, the guide rail and the dispenser, or parts thereof, can be made in one piece. Alternatively, the guide rail can be designed as an at least partially hollow member accommodating the dispenser. That is, the guide rail could comprise either, similarly as in conventional dishwashers, a projection which is formed into the side wall of the washing chamber, wherein the dispenser is provided within a hollow section of the guide rail, or an individual hollow member which is attached to the interior of the washing chamber and within which there is provided the dispenser.

The guide rail in which there is provided the dispenser preferably is affixed to the upper edge of the water-collecting bottom or to one of the inner side walls of the washing chamber, preferably to the lower end of one of the inner side walls of the washing chamber. In order to avoid that for the mounting of the guide rail holes have to be provided within the water-collecting bottom or the side walls of the washing chamber, respectively, the mounting of the dispenser preferably is done by gluing or other adhesive techniques.

In order to facilitate the dissolution of any additives in the cleaning water to be circulated within the washing chamber, the guide rail in which there is provided the dispenser preferably is located in the lower portion of the washing chamber. That is, in a dishwasher that comprises an upper and a lower basket, guide rail in which there is provided the dispenser preferably supports the lower basket In preferred embodiments of the dishwasher the door is hinged essentially about its lower horizontal edge, wherein the interior wall of the door forms part of the washing chamber when the door is closed comprises a track for a basket, which track is aligned in one plane with the guide rail in which there is provided the dispenser, when the door is in its fully open position. In dishwashers, where the opened door forms a tray onto which the basket can be pulled out so as to facilitate the loading and unloading of dishes or other articles to be cleaned into and out of the basket, such tracks provide for a defined path of movement of the basket and hence facilitate operation thereof.

Preferably, the dispenser comprises a reservoir for storing an additive and means for feeding a certain amount of additive from the reservoir to cleaning water to be circulated within the washing chamber. While the dispenser may comprise a reservoir for accommodating for example detergent in powder form or detergent tablets, wherein at a certain time within a washing program the content of the reservoir is emptied as a whole, such as by opening a lid of the reservoir, the reservoir also may be adapted to accommodate additive for a plurality of washing cycles. Thus, the dispenser can comprise a reservoir for an additive, such as a detergent or a rinse aid, in powder, liquid, paste or tablet form, in combination with a feed means for such additive. The feed means can comprise any means for initiating and/or sustaining feeding of a respective additive into the washing liquid. Depending on the consistency of the additive, the feed means thus may comprise, for example, a feed valve and/or pump means for an additive in liquid or paste form, or, for example, a screw feeder for an additive in powder or tablet form. In case that the reservoir holds additive for a single washing cycle, such as a detergent tablet, the feed means can be an element which opens the reservoir, such as a spring-biased lid.

While the feed means can be designed to be electrically driven, such as an electromagnetic valve, an electric screw feeder, an electrically operable lid for an additive reservoir or the like, wherein the feed means can be operated at the same voltage as the remaining parts of the dishwasher, the feed means also can be designed to be operated at low voltage, for example at 24V. Furthermore, in order to avoid the necessity of having to provide for electrical connections, which particularly when the feed means is located in a region of the dishwasher which during operation of the machine comes into contact with water, the feed means advantageously is designed as an element which does not require any electricity for its activation, such as a thermal expansion element for example a wax motor, which is activated solely by temperature, and which can be employed for example to open a spring-biased lid for a reservoir for detergent in powder or tablet form, or a valve for supplying detergent in liquid or paste form.

Particularly in cases where the dispenser is designed to accommodate the additive for a single washing cycle only, measures can be taken to assist the flushing of the additive into the washing liquid, such as by providing at least one spray nozzle that is designed to direct a water jet onto the reservoir. While such spray nozzle can be provided independent from the water circulation system, it also can comprise a spray nozzle which is part of one the spray arms which during a washing cycle rotate within the washing compartment.

In order to facilitate loading of additive into the dispenser, the dishwasher may comprise a filling conduit for supplying additive to the reservoir, and preferably a filling conduit which comprises a fill opening which is located to be easily accessible by a user.

The filling conduit preferably comprises a fill opening which preferably is located near the front access opening of the washing chamber, such as a fill opening which is located at a front end of the guide rail. Particularly in embodiments in which the dispenser is designed to provide a liquid additive, such as a rinse aid, into the cleaning water to be circulated within the washing chamber, the fill opening for the filling conduit can be provided in an upper region of the inner side wall of the washing chamber, which fill opening is located near the front opening of the washing chamber, or a fill opening that is arranged in a front region of the dishwasher which when the dishwasher door is closed is hidden by the door. The fill opening also could be located so as to be accessible from the outside of the dishwasher, such as by locating the fill opening in the front panel of the dishwasher. Such a fill opening could be designed in a similar manner as a detergent drawer as it is commonly used in washing machines.

In order to prevent air from being trapped within the filling conduit during filling an additive into the reservoir, the filling conduit and/or the reservoir can be provided with a vent via which air can escape during a filling operation.

Whereas for dispensers for a liquid additive the fill opening or the reservoir may be located at a location that is remote from the dispenser, and wherein the additive can be easily fed to the dispenser or the dispenser reservoir solely by gravity, in case that other types of additive shall be used in the dispenser, provisions must be taken so that the additive is properly conveyed from the fill opening to the dispenser or the dispenser reservoir. For example, in case that the dispenser is designed to supply a detergent in powder or tablet form, the dispenser could be provided with a screw feeder so as to supply a predetermined amount of detergent at predefined times during a washing cycle.

While in the foregoing, particular reference was made to dispensers which are intended to provide detergent or rinse aids into the cleaning water, the dispenser of the dishwasher suggested herein also can be a dispenser for softening agents, salt or any other additive in liquid, paste, powder or tablet form which is to be added to the cleaning water.

If different additives shall be supplied to cleaning water to be circulated within the washing chamber, the dishwasher can comprise a plurality of dispensers, such as a first dispenser for supplying detergent and a second dispenser for supplying a rinse aid. While in a dishwasher comprising several dispensers, more than one dispenser can be provided within a single guide rail, the dishwasher alternatively may comprise a first guide rail comprising at least one first dispenser and a second guide rail comprising at least one second dispenser.

The present invention can be employed with particular advantage in dishwashers in which the guide rails cannot be directly formed into the side walls of the washing chamber but wherein anyway separate guide rails have to be provided. Thus, whereas in most conventional dishwashers the lower portion of the washing tub is made of austenitic stainless steel, so as to avoid corrosion which could be caused by the spilling of regenerative salt in the region of a salt fill opening which usually is located in the bottom of the washing tub, the bottom part of the washing tub where the salt container is located also could be designed for example as a plastic part. In this case, the walls of the washing tub could be manufactured of a cheaper steel material, such as ferritic steel which has a lower nickel content, While by using ferritic steel instead of austenitic steel, substantial savings in material costs can be achieved, ferritic steel has the disadvantage that it is less deformable than austenitic steel. Whereas when using austenitic steel for manufacturing the washing tub, the guide rails can be formed integrally into the side walls of the washing chamber, for example by deep drawing, this would not be possible when making the washing tub of ferritic steel. Particularly in such latter case where it anyway would be more feasible to provide for guide rails which are designed as separate parts which are affixed to the side walls of the washing tub, such as by gluing or the like, the present invention can be used to particular advantage by designing the guide rail so as to accommodate one or more dispensers.

Figure 2:
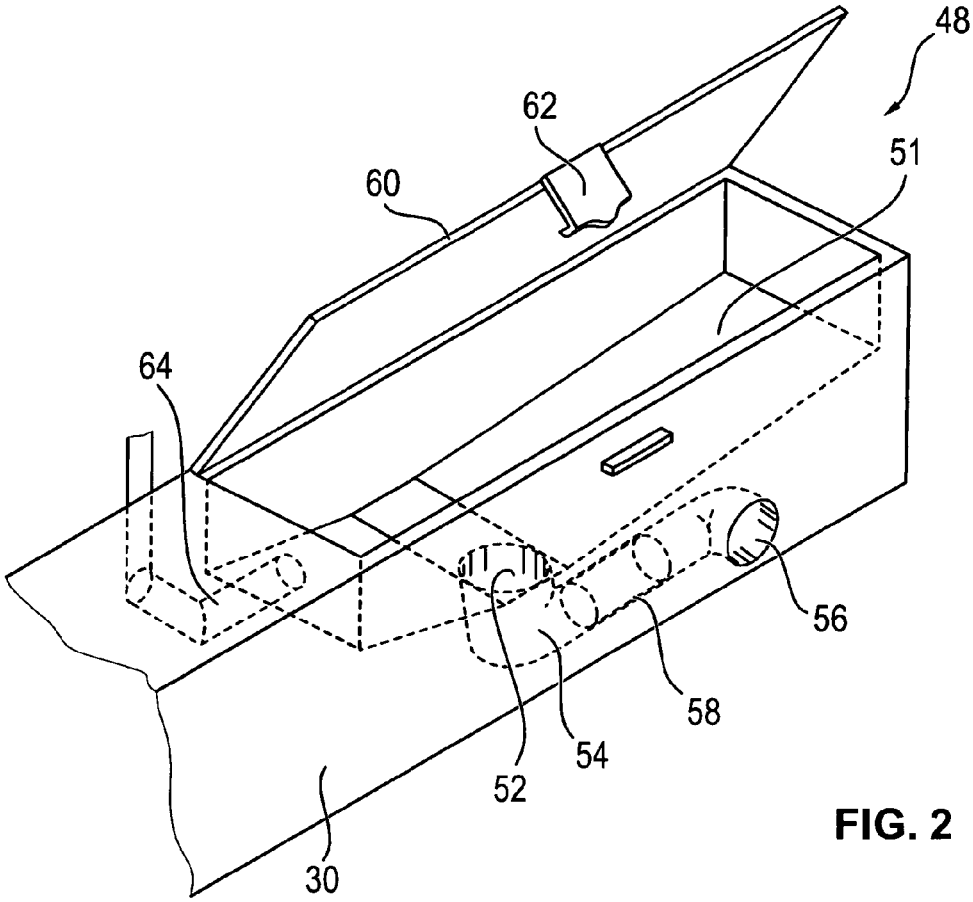
Figure 3:
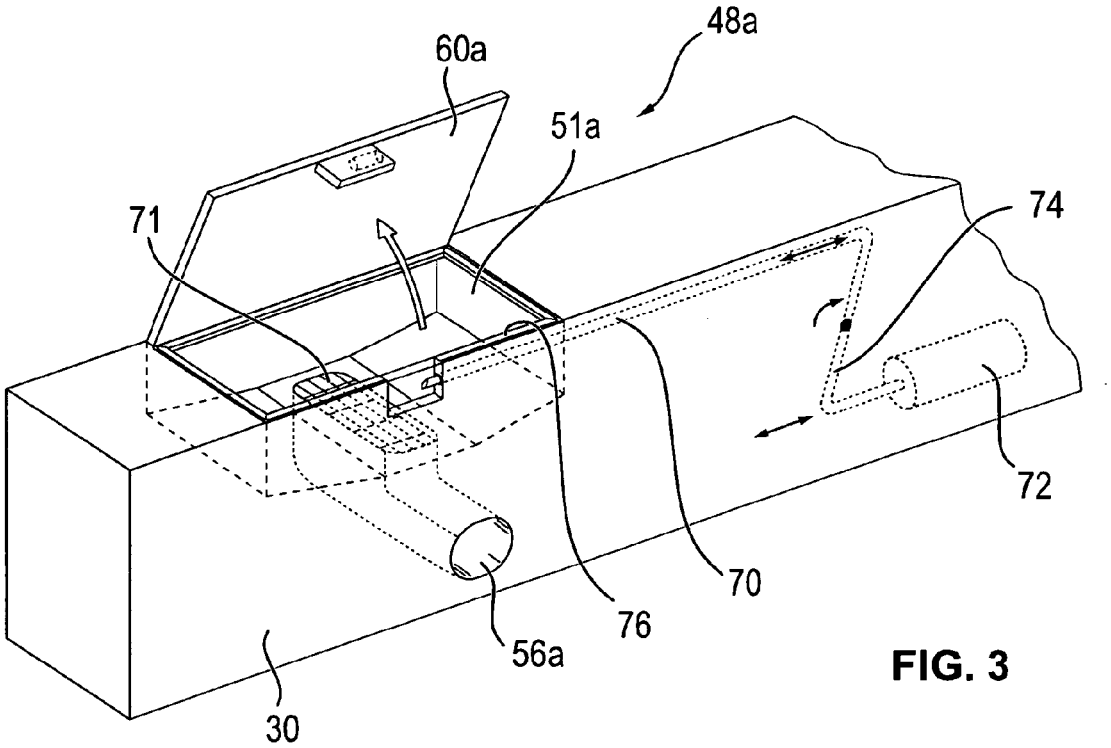

The present invention will be explained in further detail below by reference to exemplary embodiments, which are shown schematically in the drawings, in which FIG. 1 shows a dishwasher that is equipped with a dispenser in accordance with the present invention;

FIG. 2 shows an illustrative example of a dispenser located in one of the guiderails of the dishwasher shown in FIG. 1; and FIG. 3 illustrates a further embodiment of a dispenser located in one of the guiderails of the dishwasher shown in FIG. 1.

FIG. 1 shows a dishwasher 10 comprising a washing chamber 12. Washing chamber 12 is confined by a back wall 14, two opposing vertical sidewalls 16, a top wall 18 and water collecting sump member 20 which is located in the lower part of washing chamber 12. At the front of dishwasher 10, the washing chamber 12 comprises a front access opening 22 via which articles to be cleaned can be moved into and out of the washing chamber. During washing cycles the front access opening 22 of washing chamber 12 is closed by a door 23 which is hinged about a horizontal axis extending along the lower end of the front axis opening 22.

In order to hold the articles to be cleaned during a washing process, dishwasher 10 is provided with two baskets 24, only one of which is shown in FIG. 1. While the (not shown) upper basket is mounted to dishwasher 10 via a telescopic bearing system 26, so that the upper basket can be moved into and out of the washing chamber in a drawer-like manner, lower basket 24 is supported on lateral rolls 28. In particular, lower basket 24 is supported with its rolls 28 on two guiderails 30 which are affixed to the inner side walls of the washing chamber 12. In the embodiment shown in FIG. 1, guiderails 30 are affixed along the upper end of sump member 20.

The inner side of door 23 is provided with tracks 32, which are aligned to guiderails 30, so as to provide for guidance for rolls 28 of lower basket 24, when the basket is moved from within the washing chamber 12 onto the opened door 23. To this end, guiderails 30 are affixed to the inner sidewalls of washing chamber 12 such that their upper surface is located at the same level as tracks 32 when the door is in the opened state.

Within sump member 20 there is provided a spray arm 34 via which cleaning water can be sprayed onto the articles that are arranged within basket 24. Further spray arms (not shown) are provided below top wall 18 and below the upper basket. Sump member 20 is generally funnel-shaped, so that any water which collects in the sump is directed to the central portion of sump member 20, where sump member 20 is provided with a filter element 36 via which water is guided to a circulation and drain pump system (not shown).

Within guiderail 30 there is provided at least one dispenser for an additive to be added to cleaning water which is circulated throughout washing chamber 12. In the embodiment shown in FIG. 1, the dispenser comprises a fill opening 38, which is located near the front access opening 22 of washing chamber 12, and dispenser opening 40 which opens laterally into the sump. In the embodiment shown in FIG. 1, the dispenser, which is located within guide rail 30 and which can be designed to be an integral part of the guiderail 30, comprises a reservoir to accommodate an amount of additive which is sufficient to supply additive for several washing cycles. In this manner the dispenser needs not to be refilled prior to every single washing cycle, but only when the supply of additive is exhausted after carrying out a plurality of washing cycles.

In the rear part of guiderail 30 there is provided a second dispenser 48, which is designed to supply a certain amount of a liquid rinse aid into the washing liquid. Also the dispenser 48 comprises a reservoir, which is internal to the guiderail 30 and which is adapted to accommodate the rinse aid for a plurality of washing cycles. In order to facilitate the filling of the reservoir of dispenser 48, there is provided a filling conduit 50, which in FIG. 1 is shown in dotted lines and which extends through the space between inner sidewall 16 and the outer housing 52 of dishwasher 10. Filling conduit 50 extends to a fill opening, which is located behind a blind 41 provided in the front panel 42 of dishwasher 10. The fill opening for filling conduit 50 can, for example, be designed as a filling funnel which is attached at the rear side of blind 41 and which is adapted to be tilted outwardly so as to fill a liquid rinsing aid via filling line 50 into the reservoir of dispenser 48.

Within front panel 42 there further are provided displays 44 and control buttons 46. Preferably the dishwasher 10 is designed such that the need to refill any of the dispensers is displayed at display 44, wherein operation of the dispensers either is controlled via a central unit which controls the various components of the dishwasher or via a manual input at one of the switches 46.

In contrast to conventional dishwashers, wherein the detergent dispenser and optionally also the rinse aid dispenser are provided within the tiltable door, in the dishwasher 10 shown in the FIG. 1, door 23 does not contain any electrical components, so that it is not necessary to provide for electric wiring into the tiltable door.

An illustrative example of a dispenser in accordance with the present invention is shown in FIG. 2, which is an enlarged view of the rear part of guiderail 30, in which there is provided dispenser 48 for supplying liquid rinse aid into the washing liquid. Dispenser 48 comprises a reservoir 51 which is located in the interior of guiderail 30 and which is adapted for accommodating a supply of liquid rinse aid. Reservoir 51 is generally funnel-shaped and comprises at its lowermost part an outlet 52 which opens into a tube 54 via which liquid rinse aid can be passed to a dispenser opening 56, which in the embodiment shown in FIG. 2 is located laterally at guiderail 30. In order to selectively supply liquid rinse aid at certain times during a washing cycle, dispenser 48 comprises feed means 58, which in the schematic illustration of FIG. 2 is indicated as a valve situated within tube 54.

While in the embodiment illustrated in FIG. 2, the dispenser 48 is designed to be refilled via a lid 60, which is hinged to guiderail 30 and which is held in its closed position by a snap-in lock 62, dispenser 48 alternatively can be designed to be refilled via a refill line, such as via filling conduit 50 illustrated in FIG. 1.

Furthermore, in case that dispenser 48 shall be used for detergent in powder or tablet form, measures should be taken to flush reservoir 51. This could be effected by feeding water into reservoir 51 via a filling conduit 64 which is connected to the water supply of the dishwasher and which is activated together with feed means 58, or by means for opening the lid of reservoir 51 during a washing operation.

An example for such a latter embodiment is shown in FIG. 3, which is an enlarged view of a dispenser **48*a* which is located in one of the guiderails of the dishwasher shown in FIG. 1. Similarly as dispenser 48 shown in FIG. 2, dispenser 48*a* comprises a reservoir 51*a* which is located in the interior of guiderail 30**.

Reservoir **51*a* for accommodating detergent in powder or tablet form is generally funnel-shaped and comprises at its lowermost part an outlet which opens into a dispenser opening 56*a* which is located laterally at guiderail 30. In order to dissolve and flush detergent contained within reservoir 51*a*, reservoir 51*a* is provided with a spring biased lid 60*a* which when closed rests against a sealing 76 which encloses the fill opening of reservoir 51*a* and which at a desired time during a washing process can be opened by activation of an actuator 72. When activated, actuator 72 which can be an electromagnet displaces a latching pin 70 into an opening position so as to unlatch lid 60*a*. In the embodiment shown in FIG. 3, actuator 72 is connected to latching pin 70 via a linkage 74 which on activation of actuator 72 is rotated clockwise, so as to move latching pin 70 to the right in FIG. 3 so as to unlatch spring biased lid 60*a***.

Since in the closed position lid **60*a* is flush to the upper surface of guiderail 30, basket 24 is designed so as not to block opening of lid 60***a*. On the other hand, lid 60*a* is designed so as to allow unimpeded movement of the basket 24 out of the washing chamber after completion of a washing cycle, i.e. with lid 60*a* being in the opening position.

In the embodiment shown in FIG. 3, the outlet in the lowermost part of reservoir 51*a* is covered by a grid 71, which is designed to prevent clogging of dispenser opening 56*a* and to guarantee that all detergent is provided into the water circulated within the dishwasher.

If the dishwasher is provided with more than one dispenser, such as a first dispenser for the provision of detergent and a second dispenser for the provision of rinse aid, the dispensers preferably are located in the same guiderail adjacent each other so that on the one hand the number of holes which have to be provided in the washing tub for the passage of wires, feed lines and the like is minimized, and so that on the other hand a single actuator can be used for the selective activation of both dispensers.

The invention claimed is:

1. Dishwasher comprising:

a washing chamber with a top wall, a vertical back wall, two opposing vertical side walls, a water-collecting bottom at its lower end, a frontal access opening for loading articles to be cleaned, and a door for closing said access opening, at least one basket for accommodating the articles to be cleaned, wherein the basket is laterally supported for sliding movement out of and into the washing chamber on a pair of guide rails which are opposingly arranged inside the washing chamber, and a dispenser for providing an additive to cleaning water to be circulated within the washing chamber, wherein the dispenser is provided within one of the guide rails.

2. The dishwasher of claim 1, wherein the dispenser comprises an integral part of one of the guide rails.

3. The dishwasher of claim 1, wherein said guide rail is designed as a generally hollow member which accommodates the dispenser.

4. The dishwasher of claim 1, wherein the guide rail in which there is provided the dispenser is designed as a molded plastic part.

5. The dishwasher of claim 4, wherein the guide rail in which there is provided the dispenser is affixed to the upper edge of the water-collecting bottom.

6. The dishwasher of claim 4, wherein the guide rail in which there is provided the dispenser is affixed to an inside surface of one of the side walls of the washing chamber.

7. The dishwasher of claim 6, wherein the guide rail in which there is provided the dispenser is affixed to the lower end of one of the inner side walls of the washing chamber.

8. The dishwasher of claim 1, further comprising an upper and a lower basket, wherein the guide rail in which there is provided the dispenser supports the lower basket.

9. The dishwasher of claim 1, wherein the water-collecting bottom of the washing chamber is manufactured at least in part by drawing of a sheet of ferritic stainless steel sheet metal.

10. The dishwasher of claim 1, wherein the door is hinged essentially about its lower horizontal edge and its interior wall that is part of the washing chamber when the door is closed comprises a track for a basket, which track is aligned in one plane with the guide rail in which there is provided the dispenser, when the door is in its fully open position.

11. The dishwasher of claim 1, wherein the dispenser comprises a reservoir for storing an additive.

12. The dishwasher of claim 11, wherein the dispenser comprises means for feeding a certain amount of additive from the reservoir to cleaning water to be circulated within the washing chamber.

13. The dishwasher of claim 11, wherein the reservoir is adapted to accommodate additive for a plurality of washing cycles.

14. The dishwasher of claim 11, further comprising a filling conduit for supplying additive to the reservoir.

15. The dishwasher of claim 14, wherein the filling conduit comprises a fill opening which is located near the frontal access opening of the wash chamber.

16. The dishwasher of claim 14, wherein the filling conduit comprises a fill opening which is located at a front end of the guide rail.

17. The dishwasher of claim 1, wherein the dispenser is a dispenser for an additive comprising one of detergent, rinse aid, softening agent, or salt in liquid, paste, powder or tablet form.

* * * * *